US005778491A

United States Patent [19]

Baer

[11] Patent Number: 5,778,491

[45] Date of Patent: Jul. 14, 1998

[54] CONTINUOUS HINGE WITH A LONGITUDINALLY SUPPORTED PORTION AND A LONGITUDINALLY FREE END

[76] Inventor: Austin R. Baer, 24416 Hwy. 550, Ridgway, Colo. 81432

[21] Appl. No.: 774,701

[22] Filed: Dec. 26, 1996

[51] Int. Cl.[6] ..... E05D 7/00

[52] U.S. Cl. ..... 16/354; 16/234

[58] Field of Search ..... 16/354, 234, 273, 16/302, 386, 387

[56] References Cited

U.S. PATENT DOCUMENTS

| | | | |
|---|---|---|---|
| 2,495,605 | 1/1950 | Saunders et al. | 16/234 |
| 3,092,870 | 6/1963 | Baer . | |
| 3,402,422 | 9/1968 | Baer . | |
| 4,064,595 | 12/1977 | Leaver | 16/234 |
| 4,976,008 | 12/1990 | Baer . | |
| 4,996,739 | 3/1991 | Baer . | |
| 4,999,878 | 3/1991 | Baer . | |
| 4,999,879 | 3/1991 | Baer . | |
| 4,999,880 | 3/1991 | Baer . | |
| 5,001,810 | 3/1991 | Baer . | |
| 5,062,181 | 11/1991 | Bobbowski et al. | 16/354 |
| 5,201,902 | 4/1993 | Baer | 16/354 |

FOREIGN PATENT DOCUMENTS

| | | | |
|---|---|---|---|
| 1448729 | 8/1966 | France | 16/234 |

OTHER PUBLICATIONS

Roton Corporation, "*Roton Continuous Hinge*" 1989.

Hager Hinge Company "*Hager Hardware; Accent Trim & Accessories*" BuyLine 3642 (Date Unavailable).

*Primary Examiner*—Chuck Mah

*Attorney, Agent, or Firm*—Pennie & Edmonds LLP

[57] ABSTRACT

A continuous, hinge having a longitudinally supported portion and a longitudinally free end. Supports in the supported portion prevent relative sliding between pivotable hinge members. Relative longitudinal sliding between hinge members in the free end is unrestricted. In a pinless embodiment, geared hinge members are meshed and held together by a clamp. The supports comprise thrust bearings that engage laterally extending surfaces in recesses in gear segments of the hinge members. In a pinned embodiment, a continuous pin extends through aligned knuckles. The knuckles of one hinge member in the supported portion longitudinally support adjacent knuckles of the other hinge member.

34 Claims, 8 Drawing Sheets

CONTINUOUS HINGE WITH A LONGITUDINALLY SUPPORTED PORTION AND A LONGITUDINALLY FREE END

FIELD OF THE INVENTION

The present invention relates to hinges and, more particularly, to a continuous hinge in which axial and longitudinal loads are borne principally by different portions of the hinge, and to a hinge in which thrust bearings are grouped to improve the strength, wear resistance, ease of manufacturing, and flexural properties of the hinge.

BACKGROUND OF THE INVENTION

Various types of hinges are used for pivotably interconnecting two structural members. The most common form of hinge is constructed by rotatably joining two short hinge members, or "leafs," by a pin inserted into one or more knuckles formed along an edge of each hinge member. In the hardware industry, common forms of these hinges are variously known as "butt" or "mortise" hinges.

In many applications of such hinges to doors, the severe stresses placed upon such hinges cause them to fail, either because the connecting pins bend or shear, because the knuckles which envelop the pins deform or open, or because the thrust bearings sometimes placed between the interposed knuckles wear or break in use. Also, the limited number of connecting screws which fasten the leaves of these hinges to the door and frame can loosen or break. In some cases, the door and frame materials themselves are not sufficiently well constructed to resist the concentrated loads which develop at the hinges' often widely spaced attachment points. The failure of door assemblies equipped with butt hinges is often accelerated by airborne dust particles; by environmental factors, including corrosion that can damage internal sliding surfaces of hinges; by abusing hinges with wedges and props forced into the spaces between the hinges to hold doors open; and by the added impact loads imposed by vandalism.

My U.S. Pat. No. 3,092,870 discloses a pinless hinge structure offering increased performance and durability by more uniformly distributing these forces along the entire edge of the hinged structure and by essentially removing any gaps between the door and the frame. As an added benefit, the materials of construction for doors and frames may be utilized in a more efficient manner. For example, the need for threaded reinforcing plates often required to resist the localized stresses transmitted by butt hinges to their widely spaced attachment points can be eliminated. The hinge structure of the '870 patent includes two longitudinally extending hinge members that are rotatably joined along adjacent edges by intermeshing gear segments which form a part of the hinge members. A clamp maintains the gear segments in mesh relative to each other while permitting smooth and uniform movement of the hinge members through an arc of travel. The hinge structure can be formed from a wide variety of metal and plastic materials, and can be manufactured by extrusion, roll-forming, drawing, machining, molding and other forming operations.

My U.S. Pat. No. 4,999,879 teaches a different type of pinless hinge. Instead of the hinges' gear segments being meshed with each other, they are meshed to geared walls on the inside channel of the clamp. As the hinge opens and closes, the gear segments roll along the channel's inner walls.

The design and performance of pinless hinges was further enhanced by the inclusion of a thrust bearing in my U.S. Pat. No. 3,402,422. This thrust bearing design prevents longitudinal movement of each leaf relative to the other by disposing solid bearings in recesses formed in adjacent longitudinal edges of the rotatable hinge members. The bearings absorb longitudinal forces applied by one hinge member relative to the other.

In most applications of the type of hinge described in these patents, it is unusual to place only one thrust bearing within the hinge assembly unless such hinges are used in a horizontal position or in other similar conditions of minimal endwise load. Most often, multiple bearings are spaced along the length of the hinge, distributing the vertical load and frictional wear between their bearing surfaces and corresponding recesses. More bearings are used when either the longitudinal load is high, as caused by a heavy door and its attached hardware, or when the frequency of operation is high, such as in heavily used entrance doors on public buildings. In either case, additional thrust bearings reduce frictional wear by distributing the vertical load across a larger cumulative surface. Frictional wear for a particular interface of materials is a product of the load and distance traveled. A larger area spreads the load over an increased surface and reduces wear. My U.S. Pat. No. 4,999,878 teaches thrust bearing assemblies of more than one thrust bearing attached by a web. This assembly increases bearing surface and resistance against torsion applied on the thrust bearings by longitudinal loads. Also to reduce friction and wear, my U.S. Pat. No. 4,976,008 discloses a multipiece thrust-bearing assembly having bearing inserts disposed between longitudinally loaded surfaces of the thrust bearings and the hinge members.

Automatic door closers, door stops, and cushioning devices also stress door hinges during normal use. Imperfections in door and frame manufacturing and installation place additional stresses on the hinges, which may be forced to bend or twist to the shape of nonaligned attachment surfaces.

Another type of continuous hinge is a piano hinge. Piano hinges have a series of intermeshed knuckles, similar to butt hinges, but which extend along substantially the entire length of the door. These hinges, as well, can provide lateral and longitudinal support from the top to the bottom of the door. Having long hinge members, they furnish a large area to attach to a frame, reducing the stress on both the frame and screws fastened to it. The sources of stress upon these hinges are similar to those that affect the above pinless hinges. And, as with the thrust bearings in pinless hinges, a greater number of knuckles decreases frictional wear.

In the attachment of a door to a frame either by means of a continuous hinge or by several butt hinges, the lateral loads applied to the joining edges may be compared to the lateral loads found in a cantilevered beam. Assuming that the axis of the hinged joint is vertical, the topmost portion of a continuous hinge, or the topmost butt hinge, is under tension, while the bottom portion of a continuous hinge, or the bottom butt hinge, is under compression due to the moment of the door hanging from the frame. The middle portion of a continuous hinge generally undergoes the least amount of lateral stress, or in the case of a door hung on three butt hinges, the center hinge is under little lateral tension or compression and mainly helps support the door's weight.

Butt hinges or continuous hinges of either the pinned or pinless type are generally manufactured of uniform construction from end-to-end. Thrust bearings or knuckles are applied to hinges without regard to variations in the load-bearing requirements at different stations along the hinge length related to changing lateral, cantilevered loads.

Also, curvatures in a frame or a door are often present. These curvatures can occur intentionally, as in the design of walls and doors which are slightly bowed for aesthetic or structural reasons, such as in aircraft or pressure vessels. More commonly, bowing can occur in conventional doors or frames which are warped or otherwise deformed during manufacture, storage, or installation. These imperfections impose undesirable, unanticipated, and powerful random forces upon hinges, their thrust bearings, bearing surfaces, and their fastenings because the hinges are forced to accommodate more than a single center of rotation. These forces tend to shorten the operating life of all the door components.

Because prior art hinges locate hinge-member longitudinal supports, such as thrust bearings or supportive knuckles, near each end of a hinge, if the hinge is forced to bow, the endwise loading imposed on the thrust bearings is increased to extremely high levels, reducing the ability of the thrust bearings to absorb the load for which they are intended, and thus their ability to support of the weight of the door. These conditions can easily permanently damage conventional knuckles or thrust bearings and recesses in which they are disposed if they are placed near the ends of a bowed hinge.

Another disadvantage of the prior art appears during manufacture. To fabricate the thrust bearing recesses in hinge members that have uniformly spaced bearings and recesses along the entire length of the hinge, it is necessary to either use equipment of almost the length of the hinge itself in order to fabricate all bearing recesses simultaneously, or to move the hinge relative to the fabrication machine by a distance approximately equal to the length of the hinge to complete the bearing recesses sequentially. Hence, large machines and floor area is dictated.

Until now, little attention has been directed to the optimal placement of thrust bearings within the hinge assembly.

SUMMARY OF THE INVENTION

The present invention provides a continuous hinge having better load resistance to the forces imposed upon it in both the lateral and longitudinal directions to improve the performance of the hinge. This can be accomplished by grouping one or more types of bearing structures and their endwise load bearing surfaces toward the center or mid-length region of the hinge, in a longitudinally supported portion, while leaving portions of the hinge above and below the central section of the hinge length free of bearing inserts, in longitudinally free ends. Bearing placement is the subject of the present invention. Optimal longitudinal arrangement of thrust bearings of the type described in the '422 patent and of knuckles in a piano-type hinge are disclosed.

The present invention thus provides a hinge assembly that is adapted to handle the variation of the forces imposed upon a hinge at various points along the door. A continuous hinge according to the invention has a uniform cross-section with one or more thrust bearings grouped in a longitudinally supported portion of the hinge, usually at the mid-height of the door. The portions of the hinge members from the top of the door to the mid-section, which contains the bearing recesses, remain uninterrupted by any cutouts or profile discontinuities, thereby retaining optimal strength and maximum resistance to tensile loads imposed by the weight of the door. In like manner, the lower portion of the hinge is best able to sustain the compressive loads imposed by the cantilevered door when the intermeshing gear segment surfaces are continuous and uninterrupted by any thrust bearing recesses.

Ends of hinge members according to the present invention are free, to an extent, to move longitudinally relative to one another in the regions above and below the bearing inserts. This movement enables the hinge to accommodate some curvature by allowing the hinge members to slip longitudinally with respect to one another in the regions both above and below the central bearing minimally increasing longitudinal or endwise loading on the thrust bearings.

The displacement of the hinge members relative to each other will normally increase in proportion to their distance from the longitudinally supported region, as the longitudinal edges of the hinge members curve to follow any bowing in the door or frame assembly. The present invention permits the location of the portion of the hinge supported by thrust bearings to be selected by placing the group of bearings above or below the mid-height of the hinge to better resist the stress applied by door holders, door stops, cushioning, or closing devices, and automatic door operators which may distribute lateral tensile and compressive loads disproportionately along the length of a continuous hinge. If, for example, additional tensile or compressive stresses are placed upon the hinge by an overhead door closer or by a floor stop, the "neutral axis," the portion of the hinge near the mid-height usually under neither a tensile or compressive load, may be shifted slightly up or down. The bearing group may be placed in a position to compensate for these shifted lateral forces.

The present invention also provides improved support for a door that has a non-uniform weight distribution, such as a door which carries attachments such as heavy secondary hatches, latching devices, glazed or barred window openings, or doors that are oddly shaped. Selecting the vertical position of the thrust-bearing group can adapt the hinge to these unusually shifted loads.

The invention further provides maximum thrust resistance by grouping the thrust-bearing locations within a limited portion of the overall hinge length. By reducing thrust-bearing spacing to a minimum, as long as adequate shear strength is maintained in portions of the hinge members between the thrust bearings' recesses, higher loads can be carried compared to a hinge of similar cross-section constructed with the same number of widely spaced thrust bearings. This is because closely grouped bearings more uniformly distribute stress and wear when the endwise slippage of one hinge member relative to the other is slight. This grouping allows the thrust bearings to better maintain their bearing surfaces perpendicular to the axis of hinge rotation and free of twist or excessive play caused by conditions other than door weight which could force longitudinal displacement between the hinge members.

The present invention also simplifies the manufacture of pinless continuous-hinges and reduces costs. By locating the bearing recesses in a concentrated area, less fabrication equipment and floor space is required. Thus, the placement of thrust bearings into their respective recesses during assembly can be more easily automated and inspected. The wide variety of hinge lengths to fit doors of various heights is simplified from both a manufacturing and inventory standpoint because with thrust bearings grouped closely near the midpoint of a continuous hinge, the overall length may be altered somewhat with little consequence. During installation, when continuous hinges are frequently cut to a shorter length in the field, the overall length of the hinge may be modified without removing any bearings, the removal of which would reduce the longitudinal load rating of the hinge.

The closest longitudinal grouping of thrust bearings compatible with the strength of portions of the hinge members between the recesses represents an ideal design condition. The size and location of the hinge portion that is longitudinally supported by the bearing group will depend on the door it supports. Tall, narrow doors produce large vertical loads but relatively low cantilevered loads. Shorter, wide doors impose large lateral loads in both tension and compression, but may produce relatively lower vertical loads.

The invention additionally permits a continuous hinge to be designed for specific operational conditions, such as non-uniform impact or twisting forces. By varying the quantity and position of the group of thrust bearings, the problems created by these conditions can be effectively overcome. At extreme design conditions, the bearing group may be placed at or near one end of the hinge if the goal dictates maximum longitudinal displacement of the hinge members relative to each other or maximum lateral load resistance at the opposite end of the hinge.

For any particular design criteria of pinless hinge members, including scale, materials, hardness, and strength, the present invention can improve and optimize the hinge's ability to carry high loads for a large number of cycles. In this regard, the present invention is not limited to the pinless hinges of my '870 and '422 patents, but may be equally effective in other types of continuous hinges.

This invention is not limited to continuous hinges of the pinless type, however. Another embodiment of the invention is a continuous "piano" type hinge constructed with pins and interposed knuckles. It can be used to accommodate curved surfaces. By packing the knuckles that carry longitudinal loads in a centralized group and leaving spaces between the end faces of all other knuckles, binding and buckling under bowed operational conditions can be avoided.

In a piano hinge, knuckle lengths and design need not be uniform along the entire length of the hinge. Knuckles may be shorter in a longitudinal load-bearing group to afford more thrust bearing surface, and longer knuckles may be placed at the longitudinally-unsupported ends. Design considerations should include the shear strength of the pin for maximum lateral load resistance to ensure that the pin is not damaged. Furthermore, anti-friction thrust-bearings may by fitted between longitudinal load-bearing knuckles, and anti-friction sleeve knuckles may be fitted within knuckles in the longitudinally-unsupported ends to better resist the major forces in each portion of the hinge.

DETAILED DESCRIPTION OF THE PREFERRED EMBODIMENTS

Figure 1A:
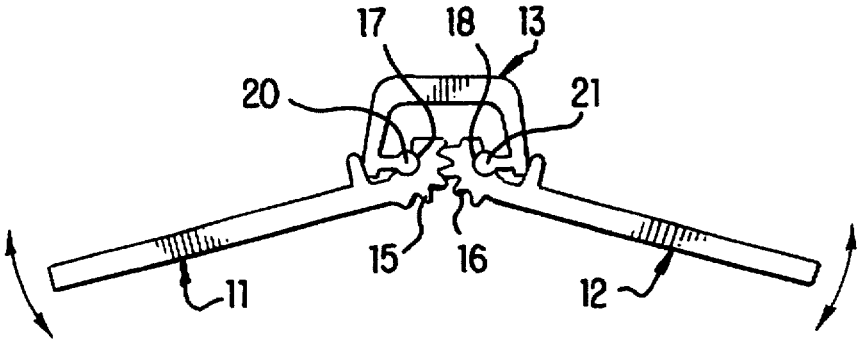
FIGS. 1A–C respectively show an end, a perspective, and a cross-section of a pinless hinge.
Figure 1C:
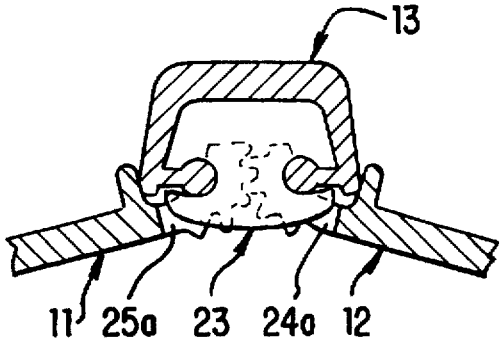
Figure 1B:
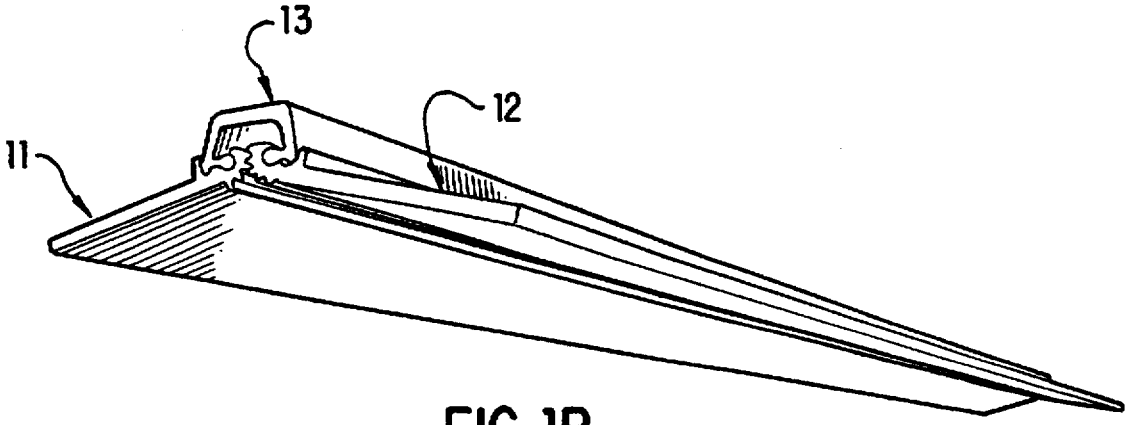

The pinless hinge structure shown FIGS. 1A and 1B comprises a first longitudinal hinge member 11 and a second longitudinal hinge member 12. These hinge members 11 and 12 have longitudinally extending gear segments 15 and 16 at adjacent longitudinal edges. Concave, cylindrical bearing surfaces 17 and 18 extend through the axes of rotation of the gear segments 15 and 16.

A C-shaped clamp 13 has a central channel. Inwardly turned ends of the clamp terminate in rod-like bearing portions 20 and 21 that are slidably inserted within the cylindrical bearing surfaces 17 and 18 of the gear segments 15 and 16. In this manner, clamp 13 rotatably joins the two hinge members 11 and 12 and keeps gear segments 15 and 16 in mesh. The clamp 13 and the hinge members 11 and 12 provide lateral support throughout the length of the hinge.

Figure 2A:
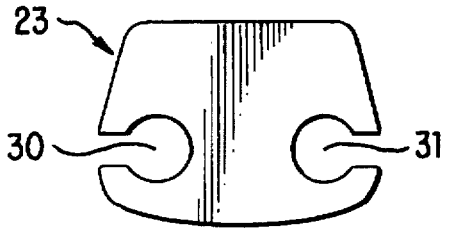
FIGS. 2A–2B illustrate an end view and a perspective view of a thrust bearing of a pinless hinge.
Figure 2B:
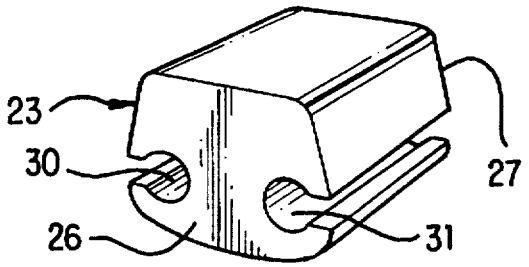
Figure 3:
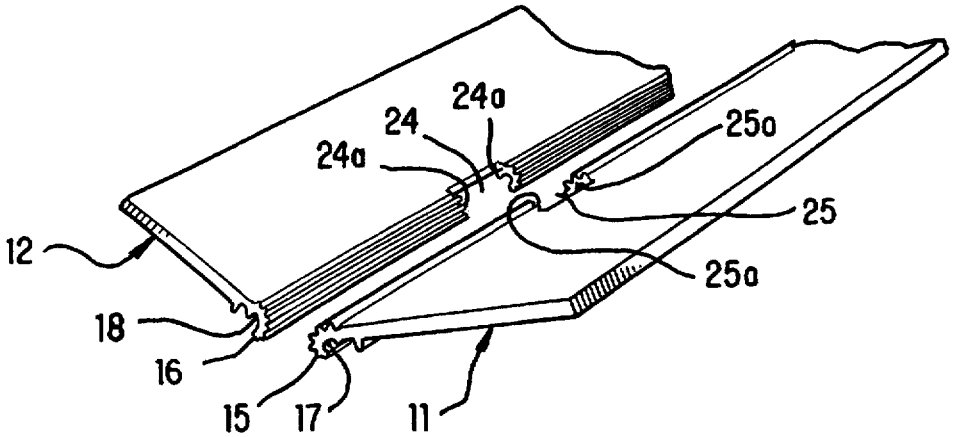
FIG. 3 is a fragmentary perspective view of hinge members of a continuous pinless hinge showing recesses that accept a thrust bearing.

To prevent relative, longitudinal movement of the clamp and both hinge members, at least one thrust bearing 23 is provided as described in my U.S. Pat. No. 3,402,422 and as shown in FIGS. 1C, 2A, and 2B. The thrust bearing 23 is disposed in recesses 24 and 25, shown in FIG. 3. Upper and lower thrust bearing surfaces 26 and 27 of the bearing 23 slidably support upper and lower recess bearing surfaces **24*a* and 25*a* of the recesses 24 and 25 when the bearing 23 is disposed therein. The longitudinal dimensions of the recesses 24 and 25 and the longitudinal dimensions of the thrust bearing 23 leave sufficient clearance between facing recess surfaces 24*a* and 25*a* and the bearing 23 so that hinge members 11 and 12 can pivot without binding on the bearing 23**.

Bearing 23 is formed with longitudinally extending slots 30 and 31, shown in FIG. 2A, configured to receive the rod-like bearing portions 20 and 21 of the clamp 13. As seen from FIG. 1C, bearing 23 largely fills the interior of the cross-section of clamp 13 and extends laterally beyond the interior of the clamp 13.

Bearing 23 effectively prevents relative longitudinal movement of the two hinge members 11 and 12 in the vicinity of recesses 24 and 25. Relative movement of the clamp 13 with respect to the two hinge members 11 and 12 is preferably prevented by securing or fastening one or more thrust bearings 23 to the clamp 13 by means of a setscrew, adhesives, crimping, or otherwise.

Figure 4A:
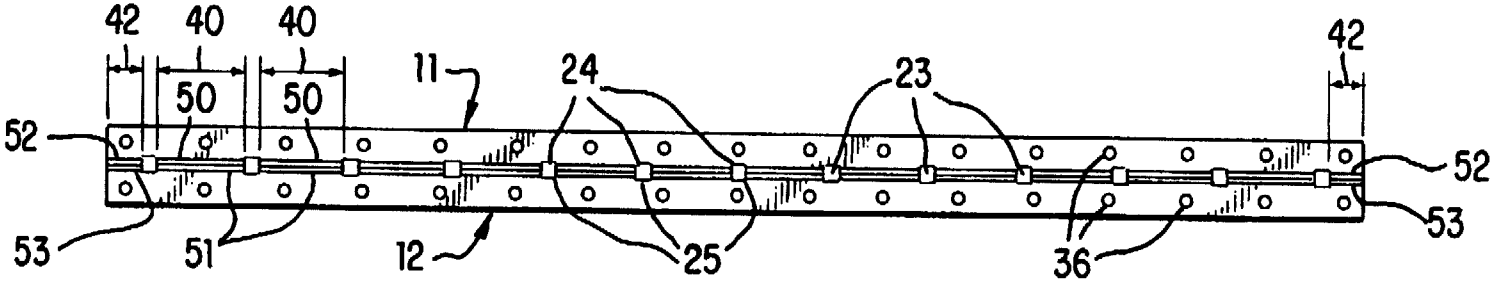
FIG. 4A shows a frontal view of an opened prior-art hinge.
Figure 4B:
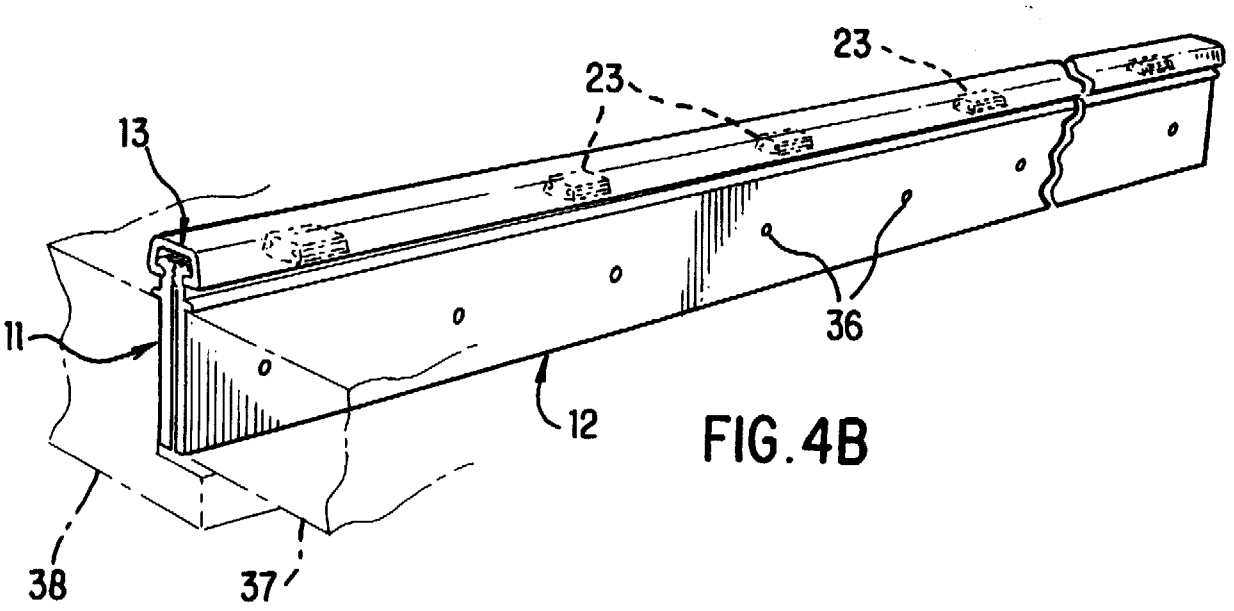
FIG. 4B is a foreshortened perspective view of a hinge assembly, showing conventionally used bearing dispositions.

FIGS. 4A and 4B show a conventional disposition of multiple thrust bearings 23 placed in recesses 24 and 25 spaced along the length of a pinless hinge. FIG. 4A shows the interior of an open hinge, its hinge members 11 and 12 forming an angle of approximately 180°. FIG. 4B is a fragmented perspective view of a similar hinge in a closed position, displaying traditionally spaced thrust bearings 23 in a ghost view. The hinge members 11 and 12 are provided with mounting holes 36 for attaching to structural members 37 and 38, such as a door and frame assembly. The increase of the cumulative bearing surface area provided by a large number of thrust bearings 23 improves the hinge members' 11 and 12 ability to resist the longitudinal forces imposed on the hinge assembly by the weight of a door and ancillary hardware.

Thrust bearings 23 of prior-art hinges are more or less uniformly spaced by spacing 40 between portions 50 and 51 of the hinge-member edges. Ends 42 and hinge member ends 52 and 53 are very short in the prior art. In known practice, length 40 and the length of ends 42 generally result from simply dividing the required hinge length by the chosen number of thrust bearings 23.

Random or uniform bearing spacing fails to take into account the magnitude and direction of cantilevered forces imposed on hinge members that support a structural member in other than a horizontal position. If a hinge is oriented in a horizontal position, with a door hanging from it, a lateral, tensile load is imposed upon it. On the other hand, if the hinge is supporting a door from below, the hinge will be in lateral compression. Either way, little endwise load acts upon the hinge, and the lateral load affecting the hinge is essentially uniformly distributed along its length. As the axis of hinge rotation shifts towards a vertical orientation, lateral forces come into play that are not uniformly distributed along the length of the hinge.

Figure 5:
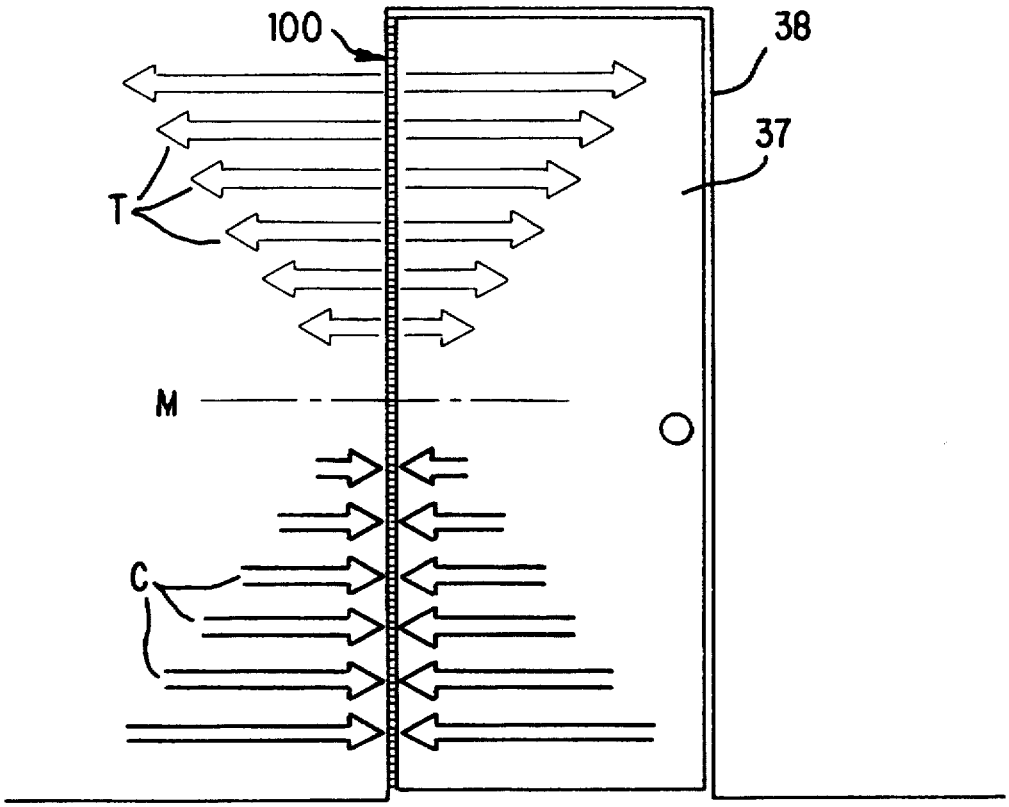
FIG. 5 is a diagram of the lateral forces imposed upon a continuous hinge by a typical door and its supporting frame.

FIG. 5 shows lateral forces in a vertically hinged door. These forces vary in magnitude and direction from one end of hinge 100 to the other. The moment of door 37 hanging from frame 38 produces lateral forces that put the upper portion of hinge assembly 100 into tension, represented by arrows T, tending to separate the hinge members. At the bottom portion of the hinge, the door's 37 moment produces lateral forces which put the lower portion of hinge 100 into compression, represented by arrows C, squeezing together the meshed gear segments 15 and 16 of the hinge members 11 and 12. In a region near the mid-height M of the hinge 100, the lateral forces produced by the weight of the door 100 are greatly diminished. Depending on installation, factors of door design, and the complex forces imposed by other operating hardware, such as door closers, the lateral components of the load imposed upon the hinge 100 will vary. The general load pattern, however, will remain.

Figure 6A:
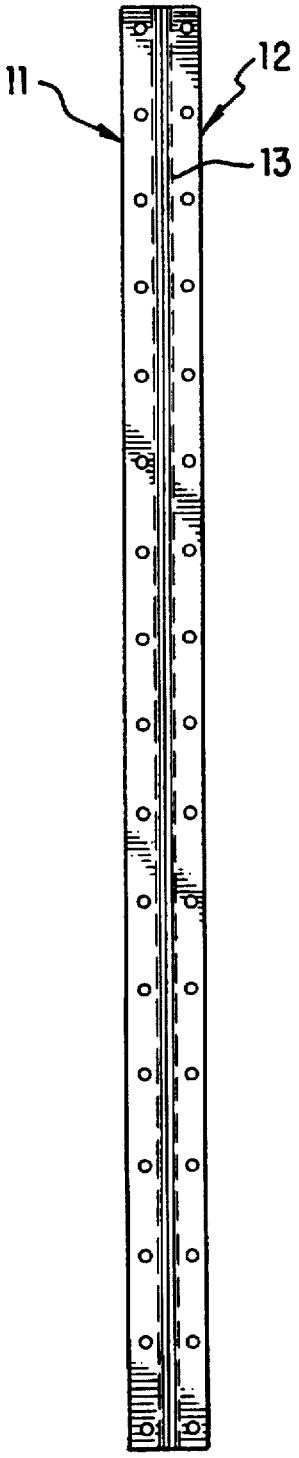
FIGS. 6A–6B are elevation views of opened pinless hinge-members slidably joined by channel-shaped clamp.
Figure 6B:
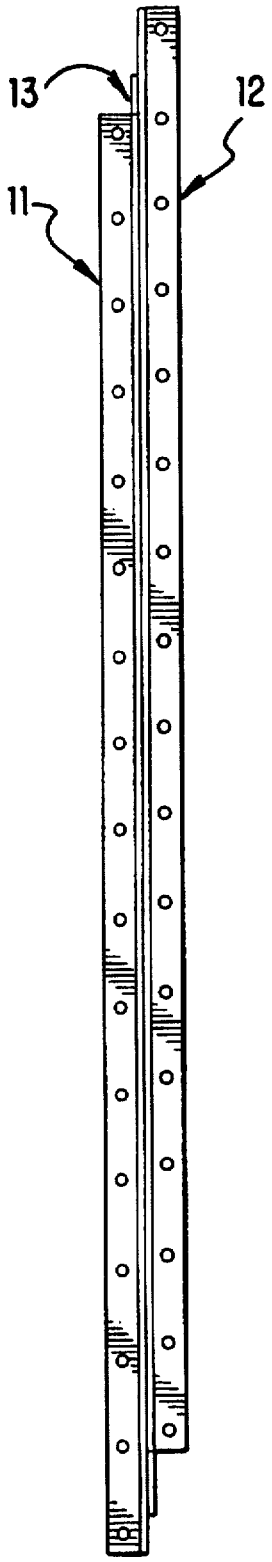

FIG. 6A and 6B, like FIGS. 1A and 1B, show pinless hinges in the open position and having neither lateral recesses 24 or 25 nor thrust bearings 23 in the hinge members 11 and 12. FIG. 6A shows hinge members 11 and 12 and clamp 13 in longitudinal alignment. FIG. 6B shows the hinge with the hinge members 11 and 12 and clamp 13 longitudinally displaced from each other due to a lack of longitudinal support.

Figure 7:
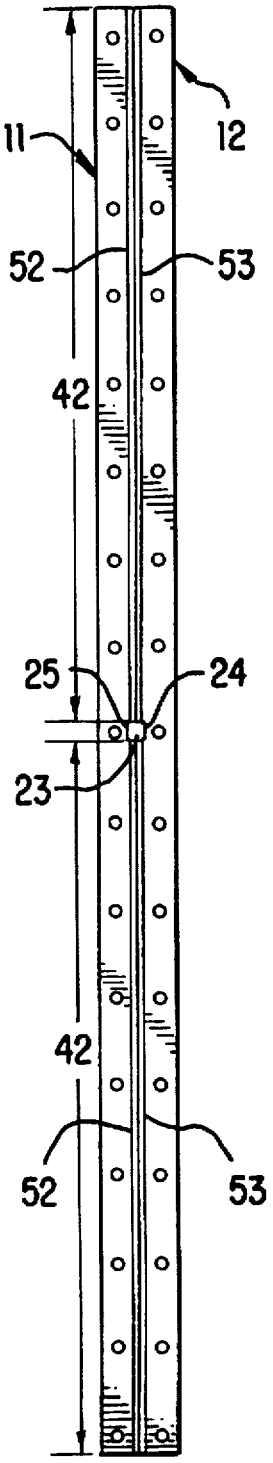
FIG. 7 illustrates an elevation view of a pinless hinge according to the present invention with a single thrust bearing placed at the mid-height of the opened hinge.

FIG. 7 shows an embodiment of the invention comprising hinge members 11 and 12 that are restrained from longitudinal relative movement between them by a single thrust bearing 23 disposed in recesses 24 and 25 at the mid-length of the hinge. Thus, the only longitudinally supported portion of the hinge is the region immediately around the bearing 23. The clamp 13 is hidden from view in this figure. In longitudinally free ends 42 located on either side of the central thrust bearing 23, the meshing gear segments 15 and 16 are uninterrupted by recesses. These geared edges 15 and 16 are thereby optimized to resist maximum lateral tensile or compressive forces present in longitudinally-free end portions 52 and 53 of the hinge members 11 and 12 above and below the bearing 23. As a result, the uninterrupted longitudinally free ends 42 of the hinge are able to withstand maximum lateral loads above or below the bearing location.

Figure 7A:
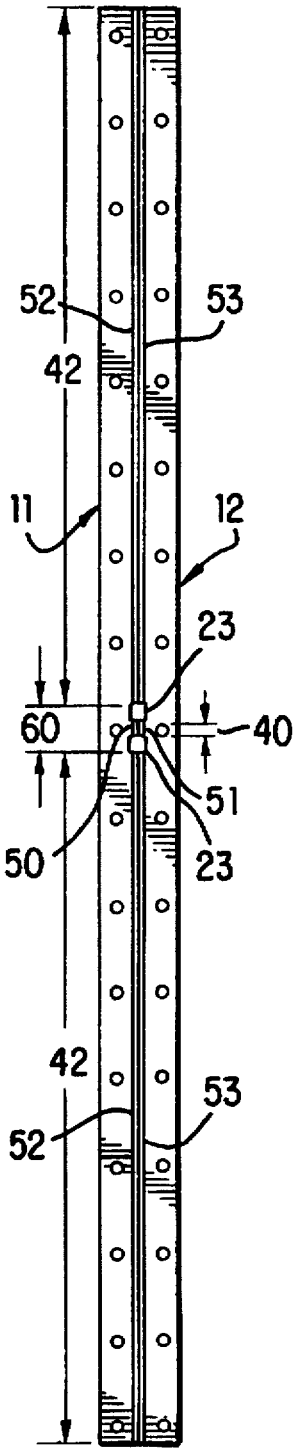
FIG. 7A shows an embodiment of the invention with two thrust bearings near the mid-height of a hinge.
Figure 8:
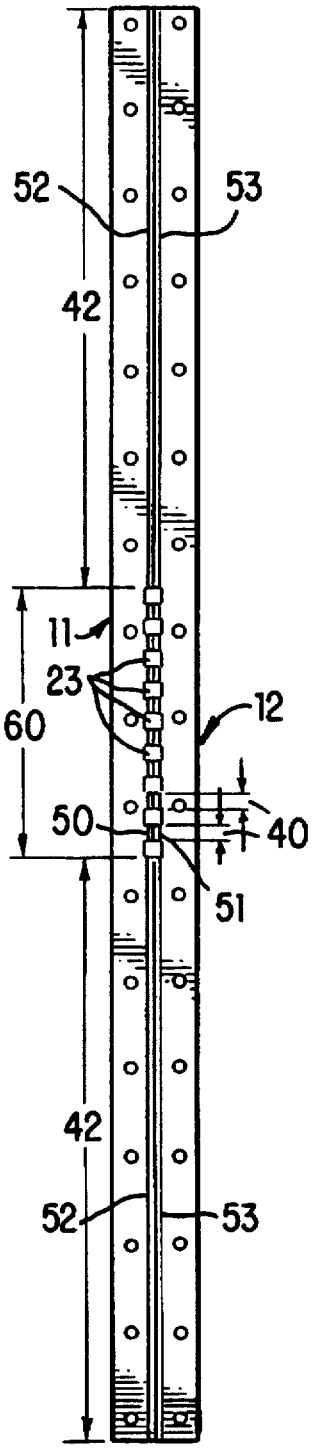
FIG. 8 shows an elevation view of an embodiment of the present invention with a group of bearings centered at the mid-height of an opened hinge.

Although one thrust bearing is shown in FIG. 7, hinges according to the invention more preferably have a group of at least two thrust bearings 23, as shown in FIG. 7A, to more adequately support longitudinal loads. FIG. 8 shows an embodiment that provides a larger group of thrust bearings 23 providing a longitudinally supported portion 60 near the mid-length of the hinge assembly. The additional bearings 23 afford greater door weight-bearing and wear resistance while retaining an uninterrupted free end 42 and hinge member ends 52 and 53 as large as possible, depending on the desired ratio of the lateral and longitudinal load requirements of the hinge assembly. Preferably, the spacing 40 between the thrust bearings 23 is as short as permitted by the endwise load-bearing capacity of thrust bearings 23 and the longitudinally supported hinge edge portions 50 and 51.

Figure 9:
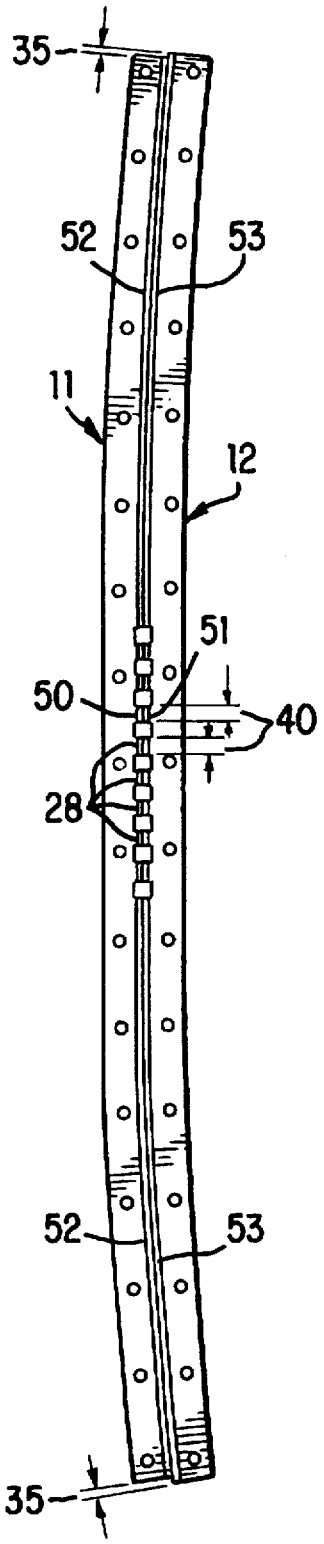
FIG. 9 is an elevation view of an embodiment of the present invention with a group of bearings located at the mid-height of an opened pinless hinge that has been forced into a curved condition.

FIG. 9 shows the hinge of FIG. 8 in a bowed condition, which may be caused by bent or warped doors or frames, or by the intentionally crowned surfaces of attached structures. Because this hinge allows longitudinal slippage between the hinge member ends 52 and 53 and the clamp 13 (not shown) in the longitudinally free end 42, the hinge can better deflect and conform to the required curvature as it pivots open and closed. There are no thrust bearings located near the hinge ends 52 and 53, as there are in the prior art hinge of FIG. 4A. Thus, recesses 24 and 25 place minimal shearing stresses on thrust bearings 23 as a result of the longitudinal displacement length 35, which is greatest at an end of the hinge. The grouped placement of the thrust bearings 23 in a distinct longitudinally supported hinge-portion enables their more efficient utilization by directing their load-bearing capacity toward supporting the weight of the door instead of resisting in shear the relative longitudinal sliding of hinge members 11 and 12.

Bearing 23 damage or failure due to loads beyond their endwise compressive strength can be largely avoided by reducing their exposure to the longitudinal displacement of end portions 52 and 53 relative to one another. As explained, this is accomplished by packing the group of bearings 23 as closely as possible, as limited by the strength of the remaining longitudinal edges 50 and 51 of the hinge members' geared portions. Spacing 40 between thrust bearings, however, need not remain constant throughout the group.

Figure 10A:
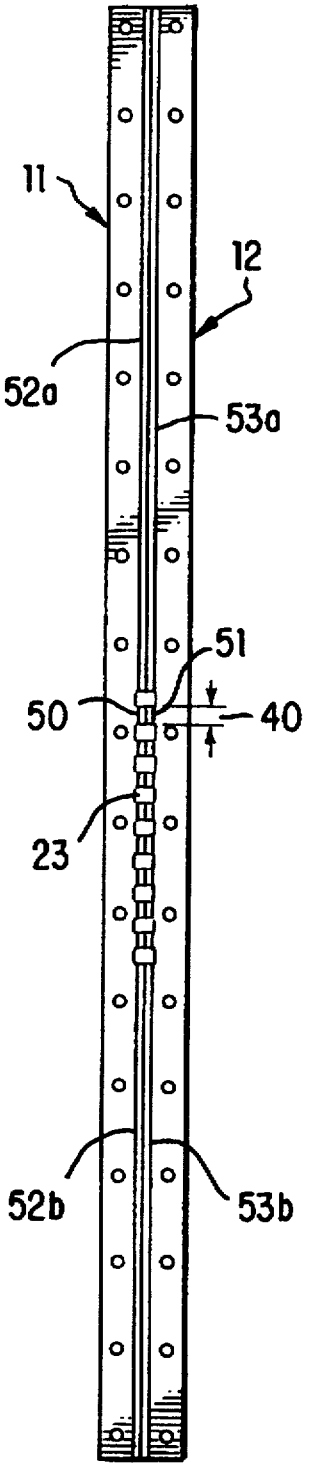
FIGS. 10A–10C are elevation views of pinless hinges according to the present invention having a group of bearings disposed in, and longitudinally supporting, various portions of the opened hinges.
Figure 10B:
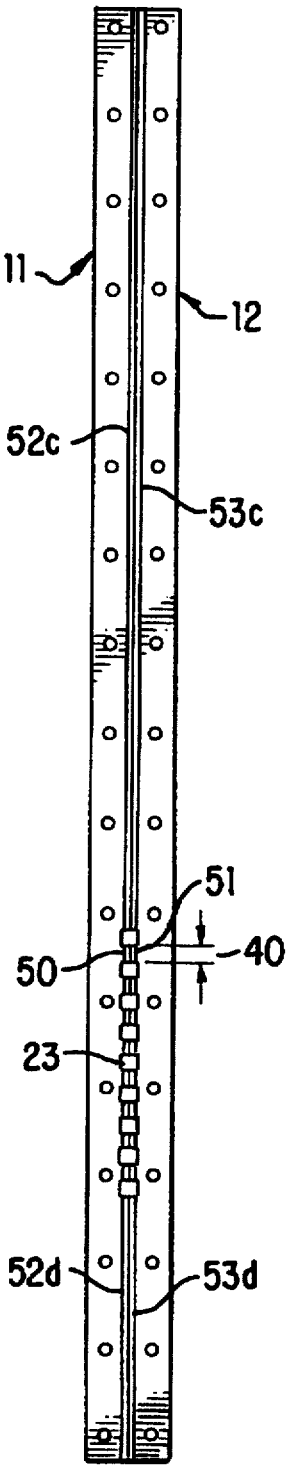
Figure 10C:
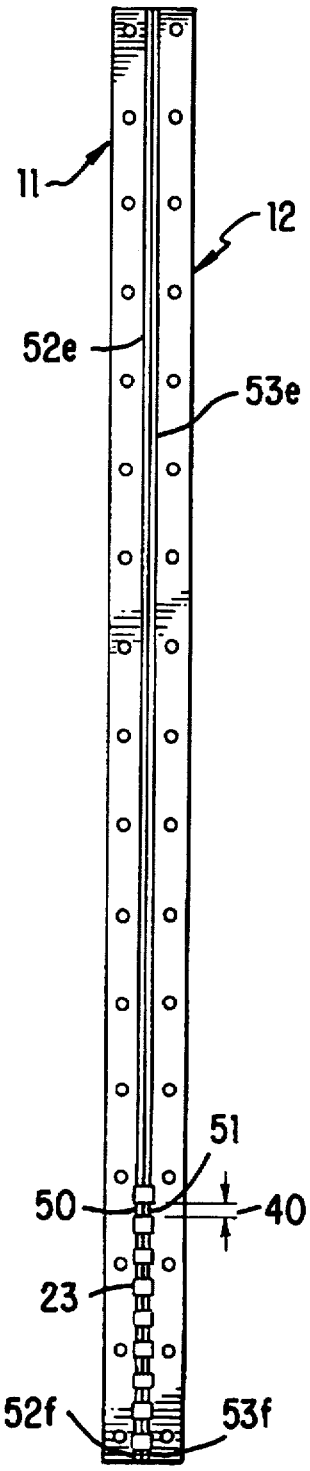

FIGS. 10A–C show the group of bearings 23 at different locations along the length of the hinge. In FIG. 10A, the bearing 23 group is displaced slightly from the mid-length of the hinge. Consequently, end portions 52*a* and 53*a*, are slightly longer than end portions 52*b* and 53*b*. This embodiment can accommodate greater lateral tensile loads at the top of the hinge assembly. This embodiment is also beneficial because hinge members 11 and 12 and clamp 13 (not shown) are more able to resist compressive loads than tensile loads for a given profile and material choice, even in a door with a symmetrical load distribution as diagrammed in FIG. 5.

The embodiment of FIG. 10B is similar to the one in FIG. 10A, but displays an even greater difference in the lengths of end portions 52*c* and 53*c* in relation to the lengths of end portions 52*d* and 53*d*. In FIG. 10C, the group of bearings 23 is at the bottom of the hinge leading to extremely different lengths of end portions 52*e* and 53*e* in relation to end portions 52*f* and 53*f*. This enables extreme tensile-load resistance in the top portion of the hinge. It also permits extreme longitudinal displacement of end portion 52*e* of hinge member 11 in relation to end portion 53*e* of hinge member 12 to accommodate deflection or curvature at the top end of the hinge assembly but retain endwise alignment of the hinge assembly at the bottom. Other embodiments are the reverse of those in FIGS. 10A–C in that the group of thrust bearings may be located in the upper part of the hinge.

Figure 11:
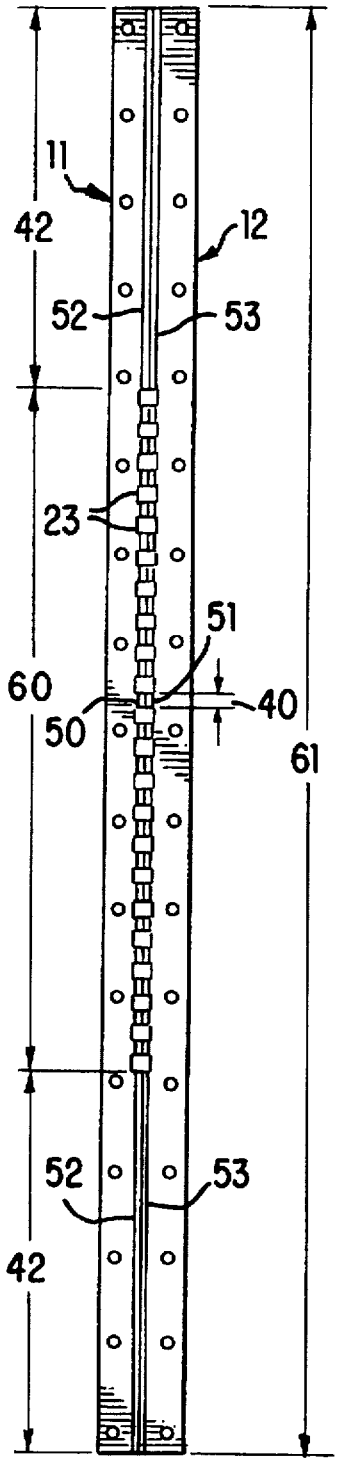
FIG. 11 is an elevation view of the present invention showing a larger group of bearings centered at the mid-height of an opened hinge according to the invention.

FIG. 11 illustrates a larger group of bearings 23 closely spaced at lengths 40. In this embodiment of the invention, hinge member portions 50 and 51 in the longitudinally supported portion 60 of the hinge occupy 50% of the overall hinge length 61. The length of the free ends 42 of the embodiment thus measure 25% of the overall length 61. This embodiment is well suited for resisting increased longitudinal loads because it employs many thrust bearings 23.

In an alternative embodiment, one or more thrust bearings interconnected longitudinally by a web, as disclosed in my U.S. Pat. No. 4,999,878, may replace individual thrust bearings. These webbed bearing assemblies are preferably spaced so that each bearing is equidistant along the longitudinally supported portion of the hinge, but equidistant placement is not required.

Another embodiment is a pinless hinge arrangement as disclosed in my U.S. Pat. No. 4,999,879. Inner surfaces of the clamp of this embodiment have gear teeth. The gear segments of the hinge members are meshed with these geared clamp-surfaces. The hinge members in this embodiment are also rotatably engaged to each other by gear segments or pivotably sliding hinge-member edges.

Figure 12:
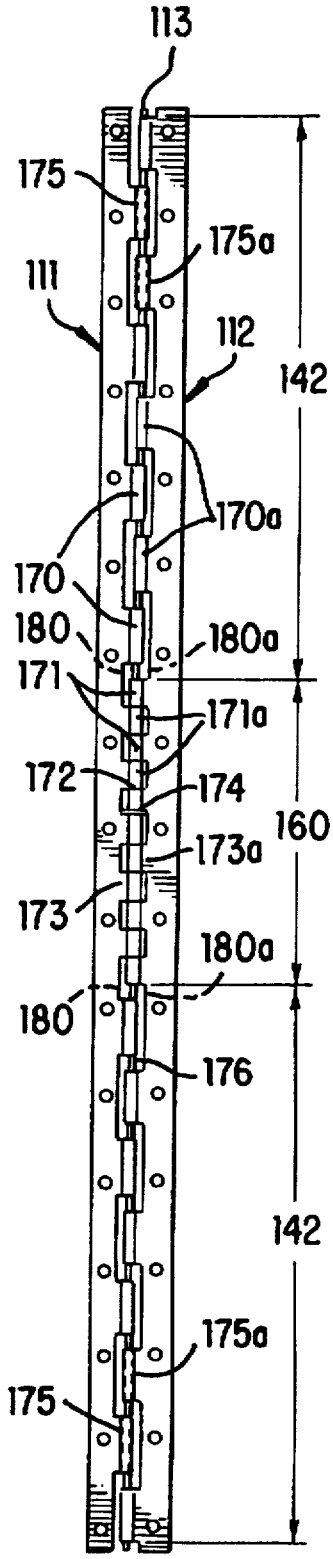
FIG. 12 shows an elevation view of an open "piano" type hinge of the present invention.

FIG. 12 shows a piano-hinge embodiment of the present invention. Concentric cylindrical knuckles 170, 170*a*, 171, and 171*a* of hinge members 111 and 112 are rotatably joined by a pin 113, or alternatively by pin segments, that extends through the knuckles. Longitudinally supportive knuckles 171 and 171*a*, disposed in a longitudinally supported portion 160, are preferably longitudinally shorter than longitudinally free knuckles 170 and 170*a*, disposed in longitudinally free ends. This size difference permits an increased number of supporting knuckles 171 and 171*a* to be grouped in a shorter space to maximize their cumulative longitudinal-load bearing surface. The maximum endwise load that the hinge assembly can carry is determined, in part, by the maximum interface area 172 between supporting knuckles 171 and 171*a*, the bending and shearing strength of shanks 173 and 173*a*, and the strength of pin 113.

Additional longitudinal or endwise load-bearing capacity may be realized by adding one or more anti-friction bearings or washers 174 within the interface 172. The maximum lateral curvature permissible in the hinge's operation can be increased by increasing the spacing 176 between longitudinally free knuckles 170 and 170*a* enabling additional longitudinal displacement between hinge members 112 and 113 in the ends of the hinge. Moreover, lateral load-bearing potential can be increased by inserting radial or sleeve bearings 175 and 175*a* within the cylindrical recesses of the free knuckles 170 and 170*a*.

The construction materials of longitudinally free knuckles 170 and 170*a* may differ from the materials of supportive knuckles 171 and 171*a* to provide the strength required of each part. So too may the construction materials of the ends 142 of hinge members 111 and 112 vary from the longitudinally supported portion 160. Different longitudinal portions of the hinge member 111 constructed from different materials may be joined together as a single piece. For example, the longitudinally free ends 142 and the longitudinally supported portion 160 of hinge member 111, having different constructions and having been fabricated separately, may be joined near line 180 by welding, brazing, riveting, or otherwise, to operate in unison as a single connected hinge member. Hinge member 112 can be built likewise.

Other embodiments of the invention need not be pinned or geared, but may comprise other hinging mechanisms that are longitudinally supported in only one portion of the hinge, but are laterally supported essentially throughout the hinge. The gearless, pinless hinge configurations disclosed in FIGS. 10 and 11 of my U.S. Pat. No. 3,402,422, for example, may also be used in embodiments of the present invention. In these hinges, at least one hinge member has a cylindrical edge that is rotatably joined to the other hinge member by a channel shaped to retain the cylindrical edge.

In all embodiments of the invention, however, the longitudinally supported portion 60 or 160 preferably occupies up to about 67% of the overall length of the hinge. The largest free end 42 or 142 of another preferred embodiment is at least about 20% of the length of the supported portion 60 or 160. More preferably, the longitudinally supported portion 60 or 160 occupies up to about 50% of the overall hinge length. Most preferably, this portion 60 or 160 occupies up to about 30% of the overall hinge length.

To the extent necessary to understand any of the preceding description, the contents of U.S. Pat. Nos. 3,092,870; 3,402,422; 4,976,008; 4,999,878; and 4,999,879 are expressly incorporated herein by reference thereto.

I claim:

1. A hinged combination comprising:

first and second hinge members of a predetermined hinge length which include a longitudinally-supported portion and a first longitudinally-free end portion that is located at an end of the hinge members, the hinge members being pivotably connected;

a longitudinal support arrangement disposed in said supported portion including a group of supports configured and associated with the hinge members for preventing relative longitudinal movement between the hinge members in said supported portion; and a pivotable structural member having an edge that has an edge end, the edge being fixed to and supported from the first hinge member with the supported portion disposed generally centrally along the edge and the first free end portion extending substantially to the edge end;

wherein the hinge members are both laterally supported relative to each other and capable of longitudinal slippage relative to each other in the first free end portion.

2. The combination of claim 1, wherein the supports are spaced from each other and an edge of at least one of the hinge members is received between adjacent supports.

3. The combination of claim 1, wherein said supported portion has a length of up to about 67% of the hinge length and sufficient to prevent relative longitudinal movement between the hinge members in the supported portion.

4. The combination of claim 1, wherein said supported portion has a length of up to about 50% of the hinge length and sufficient to prevent relative longitudinal movement between the hinge members in the supported portion.

5. The combination of claim 1, wherein said supported portion has a length of up to about 30% of the hinge length and sufficient to prevent relative longitudinal movement between the hinge members in the supported portion.

6. The combination of claim 1, further comprising a second free end portion extending to another end of the hinge members, wherein said supported portion is disposed centrally between the first and second free end portions.

7. The combination of claim 6, wherein one of the free end portions is at least about 20% as long as the supported portion.

8. The combination of claim 1, further comprising:

a gear segment being disposed on each of the first and second hinge members and having a longitudinally extending rotational axis, the gear segments being mechanically connected with each other for relative rotation therebetween; and a clamp having a channel for maintaining the gear segments in mechanical connection.

9. The combination of claim 8, wherein the gear segment on the first hinge member is pivotably meshed with the gear segment of the second hinge member.

10. The combination of claim 8, wherein the clamp has inwardly turned ends along sides of the channel, the gear segments rotatably receiving said inwardly turned ends through the rotational axes.

11. The combination of claim 10, wherein a longitudinal rod-like bearing protrusion is disposed at the termination of each inwardly turned end, said gear segments rotatably receiving said rod-like protrusions.

12. The combination of claim 8, wherein the gear segments are in longitudinally continuous rotational association in said free end portion.

13. The combination of claim 8, wherein the channel has a geared surface rotationally meshed with the gear segments of the hinge members for mechanically connecting the gear segments for relative rotation therebetween.

14. The combination of claim 8, wherein:

recesses are defined laterally though said gear segments in said supported portion; and the supports comprise a plurality of longitudinal thrust bearings, each thrust bearing being received within at least one of the recesses of each hinge member.

15. The combination of claim 14, wherein at least two of said thrust bearings are coupled by a web extending within said channel.

16. The combination of claim 14, wherein at least one of the recesses of the first hinge member at least partially longitudinally overlaps one of the recesses of the second hinge member.

17. The combination of claim 14, wherein at least one of said thrust bearings is fixed to said clamp.

18. The combination of claim 14, wherein the gear segments define opposing recess bearing surfaces extending laterally therethrough in the supported portion, each recess being defined between two of the opposing recess surfaces.

19. The combination of claim 14, wherein at least two of the thrust bearings are of independent construction.

20. The combination of claim 1, wherein said supported portion has a length of up to 20% of the hinge length and sufficient to prevent relative longitudinal movement between the hinge members in the supported portion.

21. The combination of claim 1, wherein substantially all longitudinal loads are carried by the support arrangement.

22. The combination of claim 1, further comprising a pin, wherein the group of supports comprises a plurality of supportive knuckles extending from the hinge members and pivotably connected to each other by the pin.

23. The combination of claim 1, wherein the hinge members are continuous between the supported portion and the first free end portion.

24. The combination of claim 1, wherein the hinge members are laterally supported relative to each other throughout the length of the hinge members.

25. A pinned hinged combination comprising:

first and second hinge members which include a longitudinally-supported portion and a first longitudinally-free end portion that extends to an end of the hinge members, the hinge members being pivotably connected at both said supported portion and said first free end portion;

a plurality of supportive knuckles and free knuckles on the hinge members, said supportive knuckles being disposed in the supported portion and said free knuckles being disposed in said free end portion, each knuckle defining a cylindrical through hole, said knuckles being longitudinally intermeshed with each other in both said supported portion and said free end portion such that said holes are concentrically aligned; and a pin extending through said through holes;

wherein said supportive knuckles of the first hinge member longitudinally support adjacent supportive knuckles of the second hinge member for preventing relative longitudinal movement between the hinge members in said supported portion, and the free knuckles have edges that are longitudinally spaced from one another for allowing relative longitudinal slippage of hinge members in said free end portion about the pin while providing lateral support between the hinge members.

26. The combination of claim 25, wherein supportive knuckles of one of the hinges are more closely grouped than free knuckles of the same hinge.

27. The combination of claim 25, wherein said supportive knuckles are longitudinally shorter than said free knuckles.

28. The combination of claim 25, further comprising an anti-friction bearing being disposed between a supportive knuckle of the first hinge member and an adjacent supportive knuckle of the second hinge member.

29. The combination of claim 25, further comprising an anti-friction bearing disposed between the pin and a free knuckle.

30. A pinless continuous hinged combination comprising:

two hinge members being pivotably engaged and having a longitudinally-supported portion and a longitudinally-free end portion that extends to an end of the hinge members, each hinge member comprising a gear segment having a longitudinally extending rotational axis, said gear segments being rotatably meshed and defining recesses extending laterally in said supported portion;

a clamp for maintaining the gear segments in mesh, the clamp having inwardly turned ends defining a longitudinal channel, the gear segments rotatably and centrally receiving said inwardly turned ends; and a group of longitudinal thrust bearings, each thrust bearing being retained within at least one recess of each hinge member and being slidably engageable against the recess surfaces of the recess in which each bearing is disposed; and a pivotable structural member having an edge of an edge length and being fixed to one of the hinge members;

wherein the hinge members are capable of capable of longitudinal slippage relative to each other in said free end portion, and said one of the hinge members extends along substantially the entire length of the structural member edge.

31. The combination of claim 24, wherein said supported portion up to about 50% as long as the hinge.

32. The combination of claim 30, wherein one of the thrust bearings is disposed within an at least partially longitudinally overlapping recess of each hinge member.

33. A hinged combination comprising:

first and second hinge members of predetermined length which include a longitudinally-supported portion disposed at an end of the hinge members and only one longitudinally-free end portion extending to the other end of the hinge members and being at least about 20% as long as the supported portion, the hinge members being pivotably connected at both said supported portion and the free end portion; and a longitudinal support arrangement disposed in said supported portion including a group of supports configured and associated with the hinge members for preventing relative longitudinal movement between the hinge members in said supported portion;

wherein the hinge members are laterally supported relative to each other and capable of longitudinal slippage relative to each other in the free end portion.

34. A hinged combination comprising:

first and second hinge members of a predetermined hinge length which include a longitudinally-supported portion and a first longitudinally-free end portion extending to an end of the hinge members;

a structural member fixed to and supported from each hinge member, the hinge members being connected and oriented for pivoting about a non-horizontal longitudinal axis such that lateral loads are imposed on the hinge members by the structural member in varying degree along the length of the hinge members; and a longitudinal support arrangement disposed in said supported portion including a group of supports configured and associated with the hinge members for preventing relative longitudinal movement between the hinge members in said supported portion, the supported portion having a length of up to about 50% of the hinge length and sufficient to prevent relative longitudinal movement between the hinge members in the supported portion;

wherein the hinge members are both laterally supported relative to each other and capable of longitudinal slippage relative to each other in the first free end portion such that the structural members longitudinally unrestrained in a portion beyond the free end portion opposite the supported portion, and the supported portion is disposed in a preselected location along the length of the hinge members which is affected by the smallest of the lateral loads.

* * * * *